US009057186B1

(12) United States Patent
Augustine

(10) Patent No.: US 9,057,186 B1
(45) Date of Patent: Jun. 16, 2015

(54) INTEGRALLY FORMED WATER AND SPACE SAVING LAVATORY-TOILET FIXTURE

(71) Applicant: Brian Patrick Augustine, Philadelphia, PA (US)

(72) Inventor: Brian Patrick Augustine, Philadelphia, PA (US)

( * ) Notice: Subject to any disclaimer, the term of this patent is extended or adjusted under 35 U.S.C. 154(b) by 0 days.

(21) Appl. No.: 14/259,729

(22) Filed: Apr. 23, 2014

(51) Int. Cl.
*A47K 1/06* (2006.01)
*E03D 1/00* (2006.01)
*E03D 5/00* (2006.01)

(52) U.S. Cl.
CPC ..... *E03D 1/003* (2013.01); *E03D 5/006* (2013.01)

(58) Field of Classification Search
USPC ..... 4/664, 665
See application file for complete search history.

(56) References Cited

U.S. PATENT DOCUMENTS

| | | | | | |
|---|---|---|---|---|---|
| 419,442 | A | * | 1/1890 | Hidreth | 4/625 |
| 1,868,760 | A | * | 7/1932 | Norberg | 4/665 |
| 1,935,779 | A | * | 11/1933 | Kemach | 4/665 |
| 2,860,348 | A | | 11/1958 | McClenahan | |
| 3,015,827 | A | * | 1/1962 | Iwata | 4/324 |
| 3,428,964 | A | | 2/1969 | Lucas | |
| 3,588,922 | A | | 6/1971 | Carfora | |
| 3,995,327 | A | | 12/1976 | Hendrick | |
| 4,327,941 | A | | 5/1982 | Schope | |
| 4,646,780 | A | * | 3/1987 | Spooner | 137/426 |
| 5,228,152 | A | * | 7/1993 | Fraley | 4/664 |
| 5,522,096 | A | | 6/1996 | Brown | |
| 5,749,179 | A | * | 5/1998 | Bohacik | 52/127.2 |
| 6,802,090 | B2 | | 10/2004 | Martin | |

* cited by examiner

*Primary Examiner* — Lauren Crane
(74) *Attorney, Agent, or Firm* — Brian Patrick Augustine

(57) ABSTRACT

This integrally formed water and space saving lavatory-toilet fixture enables hand washing with potable water from an existing toilet, recycles effluent completely, and provides sanitary, seamless, one-piece, full perimeter tank closure. A flexible hose re-directs supply away from the overflow through an interior fixture cavity and top cast opening toward a basin, that drains back into the reservoir as effluent; supplementing the required volume of water to complete one flush cycle. A cast sidewall basin opening is formed allowing potential drainage to flow through an internal hollow cavity directly into the tank reservoir below. The integrally formed fixture also includes a sloped front wall allowing additional hand washing space, vertically aligned space saving side and rear walls, and, an integrally formed perimeter rim conforming to the shape of the toilet tank edging below, providing hygienic, continuous tank containment and secure, detachable mounting.

3 Claims, 2 Drawing Sheets

INTEGRALLY FORMED WATER AND SPACE SAVING LAVATORY-TOILET FIXTURE

CROSS-REFERENCE TO RELATED APPLICATIONS

"Not Applicable"

BACKGROUND OF THE INVENTION

The field of endeavor to which this invention pertains, relates generally to a lavatory and toilet combination, and more specifically, to an integrally formed water and space saving lavatory adapted to detachably mount directly onto a toilet flush tank.

There have been many lavatory-toilet combinations in the prior art. For instance, the prior art patent to Fraley (U.S. Pat. No. 5,228,152) utilize piping within the existing tank to supply potable water and discharge the effluent through a drain to supplement the tank reservoir volume, but also require a custom multi-piece top fixture. The prior art patent to Brown (U.S. Pat. No. 5,522,096), re-directs potable water and recycles effluent but requires an independent multi-piece system including a gasket means to be fitted onto the top of the toilet tank. The prior art patent to Carfora (U.S. Pat. No. 3,588,922) includes a lavatory, which replaces the lid but requires potable water from a separate source. The prior art patent in Hendrick (U.S. Pat. No. 3,995,327) re-cycles water from washbasins for flushing but requires independent fixtures and supply pipes. The prior art patent in McClenhan (U.S. Pat. No. 2,860,348) presents a homogeneous combination fixture, but requires separate supply pipes and uses no tank reservoir. The prior art patent to Lucas (U.S. Pat. No. 3,428,964) supplies potable water to a basin during flush, and re-cycles "gray water" back into the reservoir but requires additional side space and tank modification. The prior art patent in Martin (U.S. Pat. No. 6,802,090) combines a lavatory having hot and cold water supplies with a tank-less toilet bowl but requires a separate drain conduit connecting two independent fixtures each having a drain line.

Given the increasing scarcity and energy required to produce potable water for human consumption, a single hygienic embodiment that overcomes the above listed individual disadvantages would ideally include: an integral lid, shell and basin formation so as to provide a sanitary, seamless lavatory surface and mounting rim, use of existing potable water dual-purposing for both hand washing and flushing, a simple means to adapt and detach said embodiment, requiring only existing fixed toilet supply and drain piping, a re-cycled effluent means, an efficient space footprint, and a minimum number of component parts.

BRIEF SUMMARY OF THE INVENTION

The object of this invention is to present a single embodiment that effectively addresses the present disadvantages in the prior art devices. The present invention solves the previous limitations of existing lavatory-toilet combinations by presenting a sanitary embodiment that simultaneously economizes space and water resources by allowing the user to multi-purpose potable water for both hand washing and toilet needs, re-cycles the effluent upon re-entry to the toilet tank reservoir by supplementing the pre-determined water volume required to complete the tank fill level as "gray water", provides a simple, one-piece removable fixture to replace or maintain an existing toilet tank lid or alternatively, be included with a new toilet, promotes "green" practices by reducing the number of manufactured components included in the combination, eliminates the need for additional domestic supply or drain piping other than currently required by a typical toilet, maximizes the efficiency of the combination by minimizing its external space footprint and reduces the potential for germs and bacteria growth on the combination by providing an easily cleanable, seamless hygienic fixture surface.

DETAILED DESCRIPTION OF THE INVENTION

Figure 1:
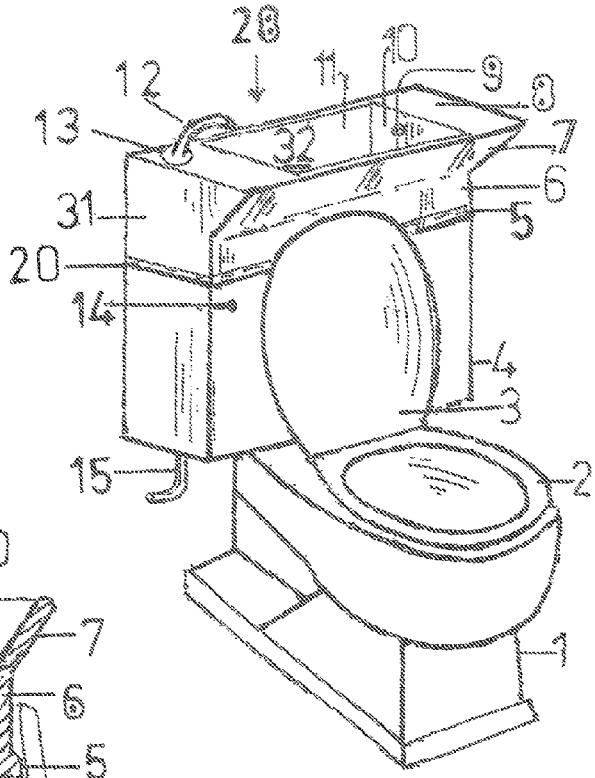
FIG. 1 is a perspective view of a typical toilet having a preferred embodiment of the integrally formed water and space saving lavatory fixture of the present invention mounted thereon.
Figure 2:
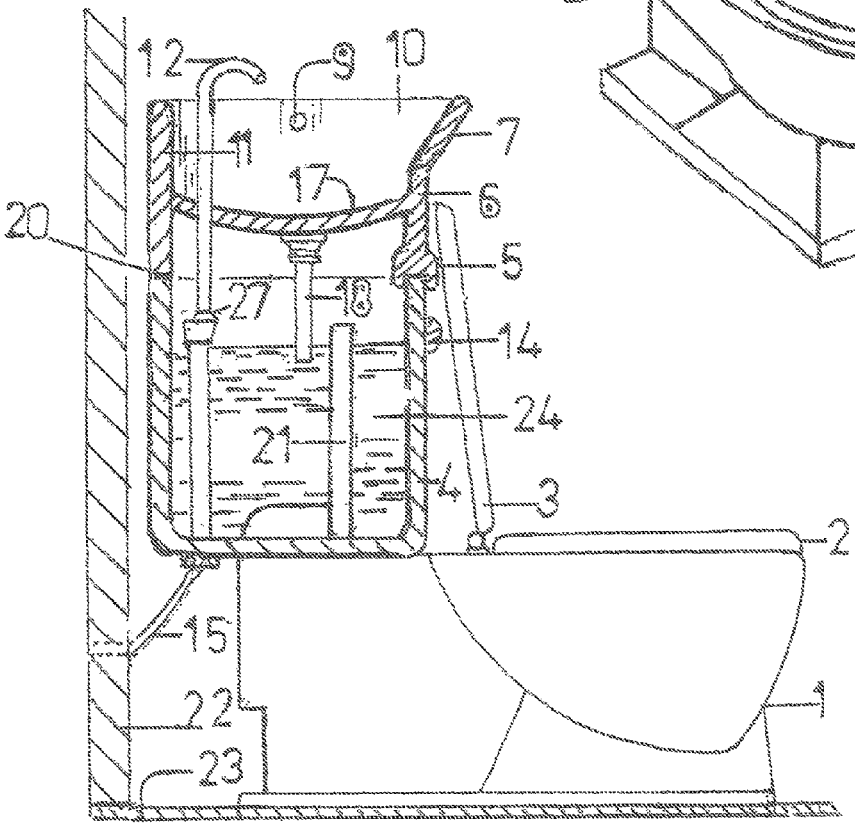
FIG. 2 is a cross-sectional view taken transversely of the integrally formed water and space saving lavatory fixture mounted directly on a typical flush tank forming the combination shown in FIG. 1 with relative floor and wall positioning.
Figure 3:
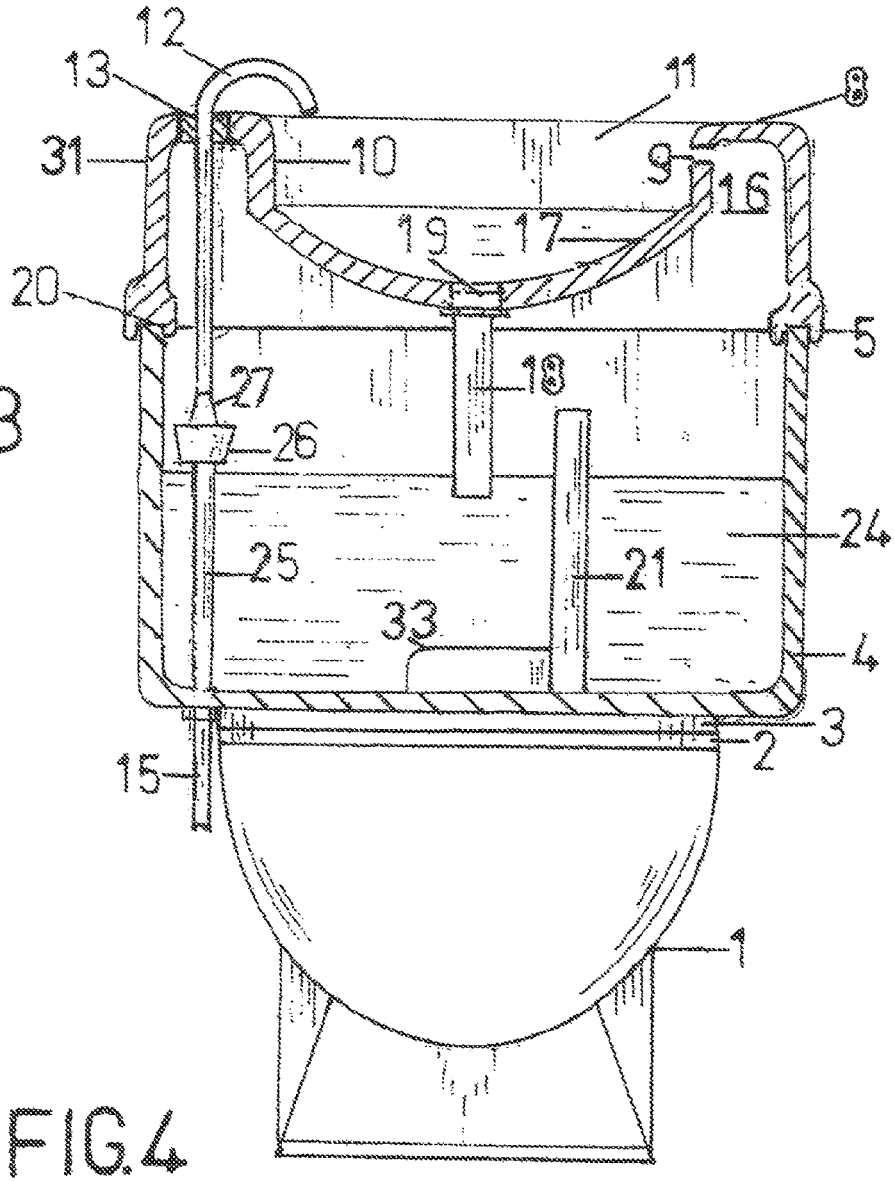
FIG. 3 is an enlarged cross-sectional view taken longitudinally of the integrally formed water and space saving lavatory fixture system mounted on a typical flush tank forming the combination shown in FIG. 1.

Referring to the same embodiment at different perspective views illustrated in FIGS. 1, 2 and 3 of the drawings by reference characters, an integrally formed water and space saving lavatory fixture generally denoted by (28) shows the fixture (28) in combination with a typical toilet comprising a toilet bowl (1) and tank (4). The bowl (1) is supported by a floor (23) and includes a seat (2) and seat cover (3). The tank generally denoted by (4) has a top perimeter edge (20) which securely supports the fixture (28) located above, and is placed adjacent to a wall (22) through which a cold water supply pipe (15) is routed and connected to the tank (4). The tank includes a water reservoir (24) that empties into the bowl (4) (1) when the flush mechanism (14) opens the reservoir valve (33). The reservoir (24) refills when the float valve (26) having an inlet port (27), opens, sending water from the domestic supply (15) to the reservoir supply (25) until a predetermined water volume is reached within the reservoir (24), causing the float valve (26) to close. A flexible hose (12) is mounted to the inlet port (27). Not shown in the drawing or specification, a typical tank configuration without the present embodiment includes the discharge end of the hose (12) detachably mounted above the overflow (21). In this embodiment, the discharge end of the hose (12) is completely removed from the overflow (21) in order to re-direct a supply of potable water to said fixture (28) when the float valve (25) is open.

For purposes of visual certainty, other component parts of the toilet have not been included in either the drawings or specifications including: the flush mechanism, control arm and chain, float device, adjustable water supply fill valve, bowl gasket and closet bolts. The toilet tank lid is not required in this embodiment and has been deleted from the specifications and drawings.

The fixture (28) comprises: an integrally formed seamless bottom perimeter rim closure (5) aligning with the tank walls (4) enabling direct, sanitary, secure yet detachable placement of the fixture (28) on the tank edge (20), said rim closure (5) includes a front and side portion that projects over top edge (20) of said tank (4) and overlaps front and side walls of said tank (4) thereby extending below said top edge rim (20) of said tank (4) and also includes a straight vertically aligned back wall, a straight vertical lower front wall portion (6) permits complete range of motion of the seat (2), and cover (3), an upper front wall sloped section (7) provides increased interior basin (32) space for hand washing, straight section rear (11) and side (10) walls allows in-line placement with the existing tank, requiring no additional space between the wall (22) and fixture (28) during new or existing retrofit application installations, an overflow opening (9) permits excess drainage to flow through an interior hollow cavity (16) located between the shell side wall (31) and the basin side wall (10) into the tank reservoir (24), a generally sloped basin bottom (17), a basin drain opening (19), and a circularly cast opening (13) in the flat top side surface (8) of the fixture (28) allowing the basin hose (12) unobstructed conduit access from the inlet port (27) upwardly between the hollow fixture cavity (16) through the top cast opening (13) toward the basin (32). A detachable drainpipe (18) is connected to the drain opening (27) and projects downwardly draining effluent into the water reservoir (24), supplementing the volume necessary to reach the predetermined reservoir level closing the float valve (25).

Although only the basic flexible basin hose (12) is shown in FIG. 1, it is understood that any spout with an adaptable water supply connection could be attached to fluidly communicate with the basin filler hose (12) exiting the top opening, (13) and detachably mount within the cast opening (13) supported by the top (8). Removal of the fixture (28) for tank (4) maintenance is accomplished simply by lifting up on the bottom perimeter rim closure (5) after the basin hose (12) is disengaged from the top (8).

Figure 4:
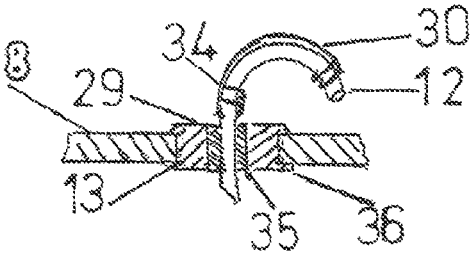
FIG. 4 is a cross-sectional view of a grommet detachably mounted within a top cast fixture opening positioning the basin hose therein, and a coil spring detachably mounted on the basin hose.

FIG. 4 shows a typical semi-flexible, circular, detachable rubber grommet (29) having circumferential top and bottom flanges (36) that retain the position of the grommet (29) within the cast opening (13) formed into the top (8). The grommet (29) includes a centrally located inner circular perforation (35) having a diameter slightly greater than the outer diameter of the basin hose (12) allowing both the basin hose (12) passage there through and stable hose (12) positioning therein. A semi-rigid retainer wire (30) formed in the general shape of a semi-circle, and including circular spring-wound end means (34), said wound means having a circumference slightly greater than the outer diameter of basin hose (12) and are detachably mounted onto said hose (12) enabling water from the discharge end of the hose to flow in a generally downward direction from the top (8) toward the basin (32).

The fixture (28) is ideally made from the same material as the toilet to provide a visually homogeneous appearance. However, if integrally formed, the fixture (28) may also be constructed of other materials such as plastic, metal or engineered composite.

Thus, I have produced a fixture in combination with a toilet, which together simultaneously provides: seamless, sanitary surface features, complete effluent "gray water" recycling capability, dual-purpose potable water usage allowance, economy of space requirements and, resource efficiency.

Various modifications may be made in the details of construction without deviating from the intent and or scope of my invention as claimed. Any modified form of the invention claimed here that includes the intent and or scope of this invention will be considered an infringement.

I claim:

1. An integrally formed water and space saving lavatory fixture for use in combination with a gravity flow toilet, said toilet having a bowl and a flush tank, said flush tank having integrally cast front, back, bottom and side walls, together forming a reservoir, a flush mechanism controlling a bottom reservoir outlet valve, said outlet integrally formed as a unit with an overflow pipe assembly, said valve and said assembly independently in flow communication with said bowl, a reservoir water supply pipe, and a float actuated valve having an supply inlet port in flow communication with a basin hose connected thereto, said hose allowing fluid conduit passage there through from said port through said fixture by providing potable water flow from said supply to said fixture, said float valve opening in response to said mechanism opening said reservoir valve, said supply providing potable water to said reservoir and said port until said float valve closes when a predetermined volume of water is re-established in said reservoir, and, said tank walls defining a perimeter top edge rim providing support whereon the improvement is mounted above said tank and comprises:

An integrally formed shell, basin, and rim closure, said rim closure having a bottom perimeter portion aligning with said tank edge providing secure, detachable, direct, continuous and sanitary mounting of said rim closure on said tank edge, said rim closure projects over said top edge rim and overlaps said front and said side walls of said tank thereby extending below said top edge rim, said shell having back, side and lower front section walls straight and vertically aligned with said tank walls, a forwardly sloped upper section front wall, angularly oriented to said vertical lower front shell wall, said upper front wall projecting both upward and outward beyond the front tank wall whereby additional space to perform hand washing is created, altogether increasing the usable interior hand wash area of said fixture, and, top side, flat shell surfaces having an integrally cast opening therein, said basin including front, back and side walls including and overflow opening integrally cast in said basin sidewall allowing overflow water to drain from said basin through said opening into said reservoir below, a sloped bottom having a drain opening and drain pipe mounted therein for draining effluent from said basin through said drain opening and said pipe into said reservoir supplementing said volume necessary to establish said predetermined volume, said basin sidewalls opposing said shell sidewalls, together forming hollow interior cavities in the space located between said walls permitting fluid conduit passage there through from said side overflow and said top cast opening through said cavity into said reservoir, said cavity and said top cast opening together providing conduit passage enabling said basin filler hose connected to said port to pass through said cavity and said top cast opening for supplying synchronized, continuous potable water flow there through from the discharge end of said hose into said basin when said float valve is open.

2. The integrally formed water and space saving lavatory fixture as claimed in claim 1 wherein a detachable hollow grommet member is detachably mounted within said top cast opening providing secure positioning of said basin hose therein.

3. The integrally formed water and space saving lavatory fixture as claimed in claim 1 wherein a semi-flexible coil spring is detachably mounted around said basin filler hose for positioning said hose in a generally downwardly direction toward said basin.

* * * * *